US009739431B2

(12) United States Patent
Loomis et al.

(10) Patent No.: US 9,739,431 B2
(45) Date of Patent: Aug. 22, 2017

(54) MODULAR LIGHT-STRING SYSTEM HAVING INDEPENDENTLY ADDRESSABLE LIGHTING ELEMENTS

(71) Applicant: Seasons 4, Inc., Toano, VA (US)

(72) Inventors: Jason Loomis, Decatur, GA (US); Nash Rittmann, Odessa, FL (US)

(73) Assignee: Seasons 4, Inc., Toano, VA (US)

( * ) Notice: Subject to any disclaimer, the term of this patent is extended or adjusted under 35 U.S.C. 154(b) by 0 days.

(21) Appl. No.: 14/576,661

(22) Filed: Dec. 19, 2014

(65) Prior Publication Data

US 2016/0183338 A1 Jun. 23, 2016

(51) Int. Cl.

| | |
|---|---|
| ***H05B 33/08*** | (2006.01) |
| ***F21V 23/04*** | (2006.01) |
| ***F21S 4/10*** | (2016.01) |
| ***F21W 121/04*** | (2006.01) |
| ***F21S 4/00*** | (2016.01) |
| *F21Y 115/10* | (2016.01) |

(52) U.S. Cl.

CPC ..... *F21S 4/001* (2013.01); *H05B 33/083* (2013.01); *F21S 4/10* (2016.01); *F21V 23/045* (2013.01); *F21W 2121/04* (2013.01); *F21Y 2115/10* (2016.08)

(58) Field of Classification Search

CPC .. H05B 37/029; H05B 37/0272; H05B 37/02; H05B 33/0815; H05B 33/0863; H05B 33/0866; H05B 33/0803; H05B 33/0857; H05B 33/0842

USPC ..... 315/185 R, 185 S, 224, 294, 201, 193, 315/32–35, 200 R, 209 R, 297, 192

See application file for complete search history.

(56) References Cited

U.S. PATENT DOCUMENTS

| | | | |
|---|---|---|---|
| 6,963,175 | B2 | 11/2005 | Archenhold et al. |
| 7,317,289 | B2 | 1/2008 | Hung et al. |
| 7,852,011 | B2 | 12/2010 | Peng |
| 7,928,667 | B2 | 4/2011 | Peng |
| 8,134,299 | B2 | 3/2012 | Peng |
| 8,203,286 | B2 | 6/2012 | Roberts et al. |

(Continued)

OTHER PUBLICATIONS

Semisilicon, ST5050832 Datasheet, RGB LED, Feb. 14, 2014, Semisilicon Technology Corp, Taiwan.

*Primary Examiner* — Alexander H Taningco
*Assistant Examiner* — Renan Luque
(74) *Attorney, Agent, or Firm* — Craige Thompson; Thompson Patent Law

(57) ABSTRACT

Apparatus and associated methods relate to modular series-connectable LED light strings having an input connector and an output connector for electrically communicating power and a control signal, an input control signal being actively level-shifted to a level suitable to a first lighting element of the LED light string. In an illustrative embodiment, the LED light string may have a plurality of series connected lighting elements that generate a series of intermediate supply voltage levels. In some embodiments, the active level shifter may bias the input control signal between an DC voltage level applied to a positive supply pin of the first lighting element and the intermediate supply voltage level generated at the connection of a negative supply pin of the first lighting element and the positive supply pin of the second lighting element. In some embodiments, active level-shifting may advantageously restore the proper bias for a series connected light string.

9 Claims, 9 Drawing Sheets

(56) References Cited

U.S. PATENT DOCUMENTS

| | | | | |
|---|---|---|---|---|
| 8,344,659 | B2 | 1/2013 | Shimomura et al. | |
| 8,350,496 | B2 | 1/2013 | Peting et al. | |
| 8,786,202 | B2 | 7/2014 | Kim | |
| 2002/0180378 | A1* | 12/2002 | Griffin | H05B 41/42 315/224 |
| 2007/0257623 | A1 | 11/2007 | Johnson et al. | |
| 2009/0021955 | A1 | 1/2009 | Kuang et al. | |
| 2009/0273303 | A1* | 11/2009 | Peng | H05B 33/0842 315/297 |
| 2009/0302771 | A1* | 12/2009 | Peng | H05B 33/0803 315/193 |
| 2011/0285299 | A1* | 11/2011 | Kinderman | H05B 37/029 315/192 |
| 2013/0293139 | A1* | 11/2013 | Sadwick | H05B 37/02 315/224 |
| 2015/0245435 | A1* | 8/2015 | Peng | H05B 33/0821 315/185 R |
| 2016/0021710 | A1* | 1/2016 | Peng | H05B 33/0809 315/185 R |

* cited by examiner

Configuration 1: 120V AC rectifier and level shifter at each string with separate control module Configuration 2: 120V AC Rectifier at control module only and level shifter at each string

MODULAR LIGHT-STRING SYSTEM HAVING INDEPENDENTLY ADDRESSABLE LIGHTING ELEMENTS

TECHNICAL FIELD

Various embodiments relate generally to illuminated light strings that have independently controllable lighting elements.

BACKGROUND

Unique customs and practices surround each holiday. The customs and practices of each holiday have evolved over the years. Using lights as holiday decorations goes back many years. Before electricity, candles were attached to holiday trees. In today's age of electricity, the use of holiday lights has become commonplace, especially during winter holidays, such as Christmas or Chanukah. Holiday lights are used both indoors and outdoors. Some people place illuminated figures in their yards during the Advent Season. Others decorate their homes with lighting strings. Some people place Santa figures upon their rooftops. And some people decorate outdoor trees and shrubs with trees and/or ornaments. Indoor Christmas trees too are often illuminated using light strings.

Light strings are bought and sold in various color configurations. Some light strings use incandescent lamps. Some light strings use Light Emitting Diodes (LEDs). Some light strings employ fiber optic glass elements. Each different type of lighting element may provide a different lighting effect.

SUMMARY

Apparatus and associated methods relate to modular series-connectable LED light strings having an input connector and an output connector for electrically communicating power and a control signal, an input control signal being actively level-shifted to a level suitable to a first lighting element of the LED light string. In an illustrative embodiment, the LED light string may have a plurality of series connected lighting elements that generate a series of intermediate supply voltage levels. In some embodiments, the active level shifter may bias the input control signal between an DC voltage level applied to a positive supply pin of the first lighting element and the intermediate supply voltage level generated at the connection of a negative supply pin of the first lighting element and the positive supply pin of the second lighting element. In some embodiments, active level-shifting may advantageously restore the proper bias for a series connected light string. Various embodiments may achieve one or more advantages. For example, some embodiments may permit the series connection of many LED light strings. In some embodiments, the power distributed to a last LED light string of may be substantially equal to the power distributed to a first LED light string. In some embodiments, connecting individually controllable light elements in series may permit the use of a high DC voltage to power the series connected light elements. Series connected light elements may draw a smaller operating current that parallel connected light elements. In some embodiments, a string of series connected light elements may be in turn series connected to other strings of series connected light elements. Because of the low current draw of such strings, the voltage sag of series connected strings may advantageously be small.

In some embodiments, the control signal may be advantageously buffered by the active level shifter. The integrity of the control signal may be maximized by the use of active elements in the level shifter. In an exemplary embodiment a control signal may be sent from a first lighting element and received by a second lighting element of each adjacent pair of the series connected lighting elements. As the control signals are transmitted throughout the series connected lighting elements, the DC bias of the control signals may change. The active level shifter may advantageously restore the DC bias of the control signal received by a subsequent light string connected thereto.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
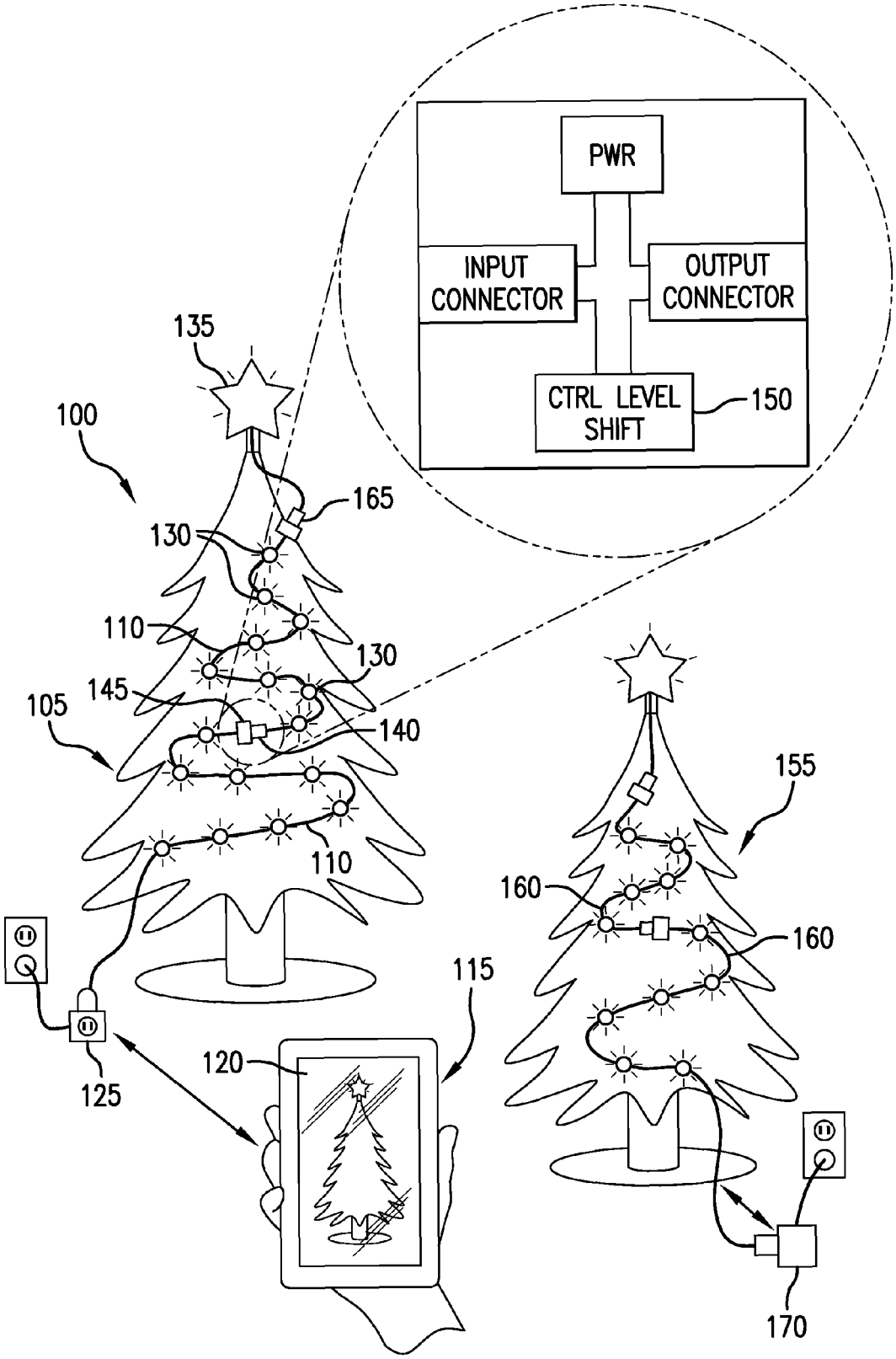
FIG. 1 depicts an exemplary holiday lighting display system.

FIG. 1 depicts an exemplary holiday lighting display system. In the FIG. 1 depiction, a holiday lighting display 100 includes two holiday trees 105, 155, each of which have LED light strings 110, 160 draped upon the boughs. The holiday lighting display 100 may have been programmed to perform a dynamic lighting show. A mobile computing device, such as a smart phone 115 may facilitate the programming and/or control of the holiday lighting display 100. The smart phone 105 may have an application (APP) that receives lighting commands from a user input 120. The smart phone 115 may transmit the received lighting commands to a first receiver module 125. The first receiver module 125 may send control signals that independently control each of a series of lighting elements 130. Some of the independently controllable lighting elements 130 may be part of one of the LED light strings 110. Some of the independently controllable lighting elements 130 may be part of an illuminated ornament and/or a tree-top ornament 135, for examples. The control signals sent by the first receiver module 125 may serially be transmitted through the independently controllable lighting elements 125. Each LED light string 110 may have an input connector 140 and an output connector 145. The control signals, after having serially traversed a first of the LED light strings 110, may be transmitted via the output connector 145 of the first of the LED light string 110 to the input connector 140 of a second of the LED light strings 110.

The independently controllable lighting elements 130 of a single LED light string 110 may be serially connected one to another. This serial connection configuration may result in a level shifting of the control signals traversing the LED light string. For example, the control signals may have a high DC bias when transmitted to a first of the independently controllable lighting elements 125 of an LED light string 110. Then, the DC bias of the control signals may be level shifted toward a circuit ground reference potential when transmitted to each subsequent independently controllable lighting element 125 of the LED light string 110. The control signal that emerges from a last of the independently controllable lighting elements 125 may have a modest DC bias in comparison with the initial DC bias of the control signal when transmitted to the first of the independently controllable lighting elements 125. The control signal is then level shifted by an active level shifter 150 before being transmitted to a first of the independently controllable lighting elements 125 of an LED light string 110 connected in series with a first LED light string 110.

The depicted holiday lighting display 100 has a second holiday tree 155 that has LED light strings 160 draped upon the boughs. The LED light strings 110, 160 of the two holiday trees 105, 155 may be controlled to display a coordinated dynamic lighting show. The control signal may be transmitted by a transmission module 165 to a second receiver module 170 electrically coupled to the LED light strings 160 of the second holiday tree 155. One or both of the first 120 and the second 170 receiver modules may level shift the received control signals by an active level shifter.

Figure 2A:
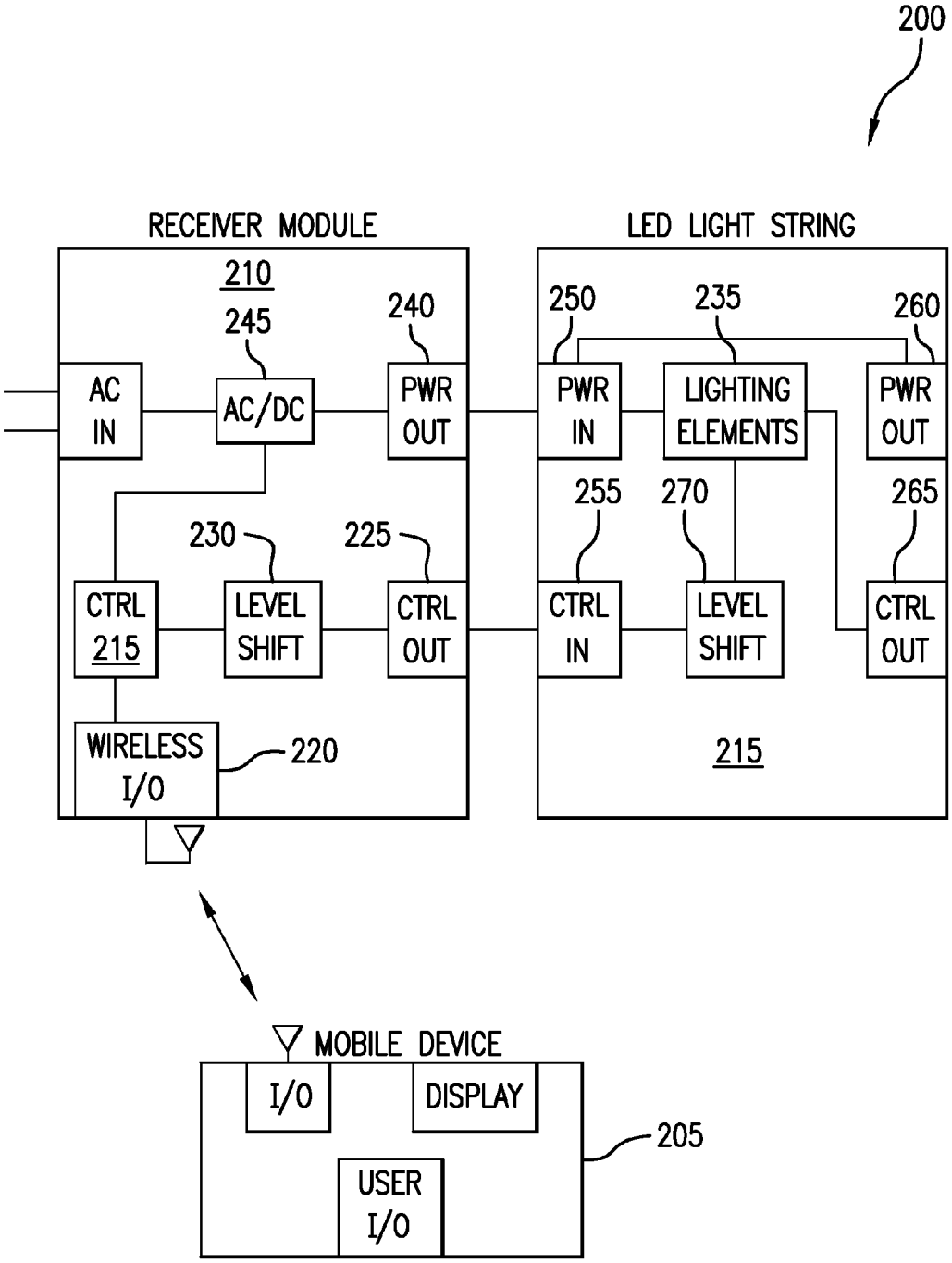
FIG. 2A depicts a block diagram of an exemplary system of light strings that have independently controllable lighting elements.

FIG. 2 depicts a block diagram of an exemplary system of light strings that have independently controllable lighting elements. In the FIG. 2 depiction, an exemplary lighting display system 200 includes a mobile device 205, a receiver module 210, and an LED light string 215. The mobile device 205 may have an APP running thereon for providing lighting control functionality. The mobile device 205 may be in wireless communication with the receiving module 210.

The receiver module 210 may have a controller 215 that receives the wireless communication from a wireless interface 220. The received wireless communication may include control signals configured to independently control a series of lighting elements, for example. The receiver module 210 may provide these received control signals to an output port 225 to which an LED light string 215 may connect. The LED light string 215 may require the control signals to have a particular DC bias. The depicted receiver module 210 has an active level shifter 230 that voltage shifts the control signal to the particular DC bias required by the LED light string 215.

The LED light string 215 may require power in addition to the control signal for operation of a series of independently controllable lighting elements 235. The receiver module 210 may provide operating power for the LED light string 215 to a power port 240. In various embodiments, various operating power specifications may prevail. For example, in some embodiments, 110 AC power may be provided to the output port 240. In some embodiments, a DC voltage may be provided to the output port 240. In an illustrative embodiment, an AC/DC converter 245 may convert line power to a high DC voltage level. In various embodiments, the converted DC voltage level may be about 15, 20, 30, 38, 45, 62, 75, or about 80 volts, for example. A high DC voltage level may advantageously minimize the voltage drop of serially connected LED light strings. Minimizing the voltage drop of serially connected LED light strings may permit a last lighting element of such LED light strings to have an illumination range substantially equal to that of a first lighting element of such LED light strings.

The depicted LED light string 215 includes a power input port 250, a control signal input port 255 and a power output port 260 as well as a control signal output port 265. In the depicted embodiment, the power received on the power input port 250 is directly coupled to the power output port 240 for providing operating power to another LED light string there-connected. The LED light string 215 has an active level shifter 270 for biasing the received control signals to a DC bias level in which a first of a series of independently controllable lighting elements 235 may require. The control signal may then ripple through the series of independently controllable lighting elements 235 in a series fashion from a first lighting element to a last lighting element. In some embodiments, the LED light string 215 may receive a control signal that is already level shifted to an appropriate level for the first lighting element. The LED light string 215 may then level shift the control signal that is transmitted from a last of the independently controllable lighting elements 235. The level shifted signal may then be coupled to the output control port 265 to be made available to another connected LED light string 215.

Figure 2B:
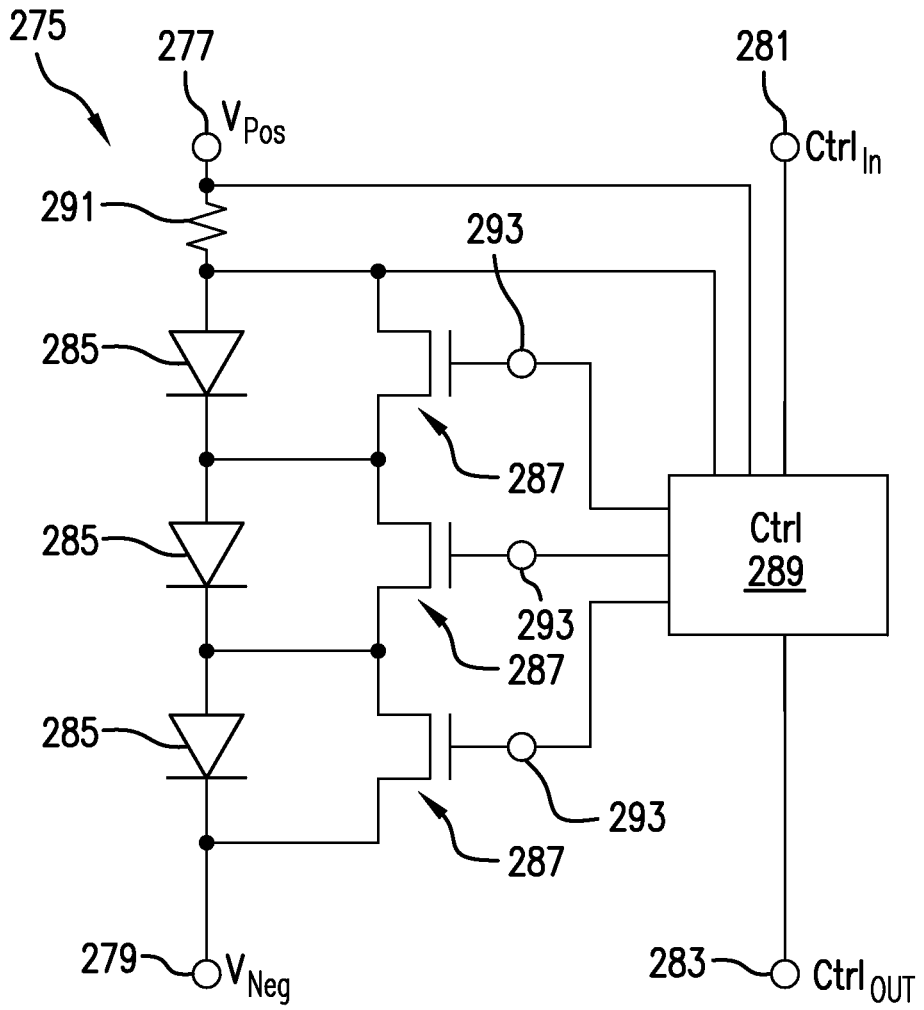
FIGS. 2B-2C depict exemplary controllable lighting elements.

FIG. 2B depicts an exemplary controllable lighting element 275. The controllable lighting element has a positive supply pin 277, a negative supply pin 279, an input control pin 281, and an output control pin 283. In the depicted embodiment, the controllable lighting element has three LEDs 285. Each of the three LEDs 285 may be of a different color, for example. In some embodiments, a red, a blue, and a green LED may be used. In an illustrative embodiment, a cyan, a magenta, and a yellow LED may be used. Each of the three LEDs 285 are wired in series. A bypass device 287 is wired in parallel with each of the LEDs 285. The bypass device 287 may be a transistor, for example.

A control module 289 may receive a control signal for the controllable lighting element 275 on the input control pin 281, for example. The controller may provide a control signal to each of the bypass devices 287 in response to the receive control signal. For example, the control module 289 may receive a control signal to operate a red LED 285 in a full on mode, a blue LED in a full off mode, and a yellow LED in a 50% on mode. The controller may sense the operating current via a sense resistor 291, for example. The controller may then supply control voltages to the gates 293 of each of the bypass devices 287 that shunt the appropriate amount of current from each of the LEDs. The controller may then send the control signal to the output control pin for use by the next lighting element connected thereto.

Figure 2C:
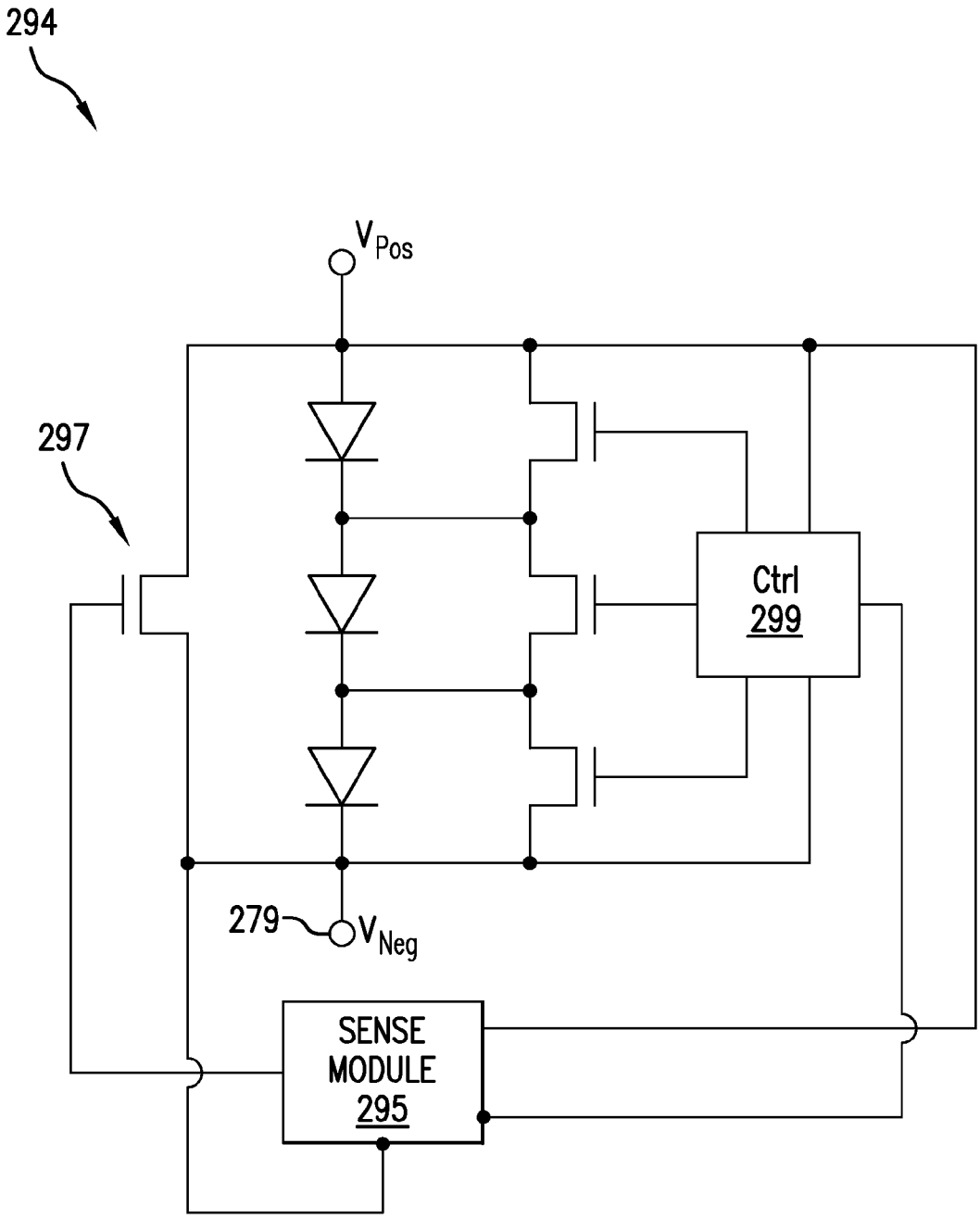

FIG. 2C depicts an exemplary controllable lighting element 294. In the depicted embodiment, the control signal may be multiplexed onto the power signal. For example, in some embodiments, the receiver module 210 may have a single shared port for both providing power and control signals to an LED light string 215. The control signal may then be sensed by a sensing module of the LED light string 215. For example, a high-frequency current (and/or voltage) may be coupled to the power port 240. The LED light string 215 may then have a sensing module that senses the high frequency signal superimposed upon the power port 240.

Figure 3A:
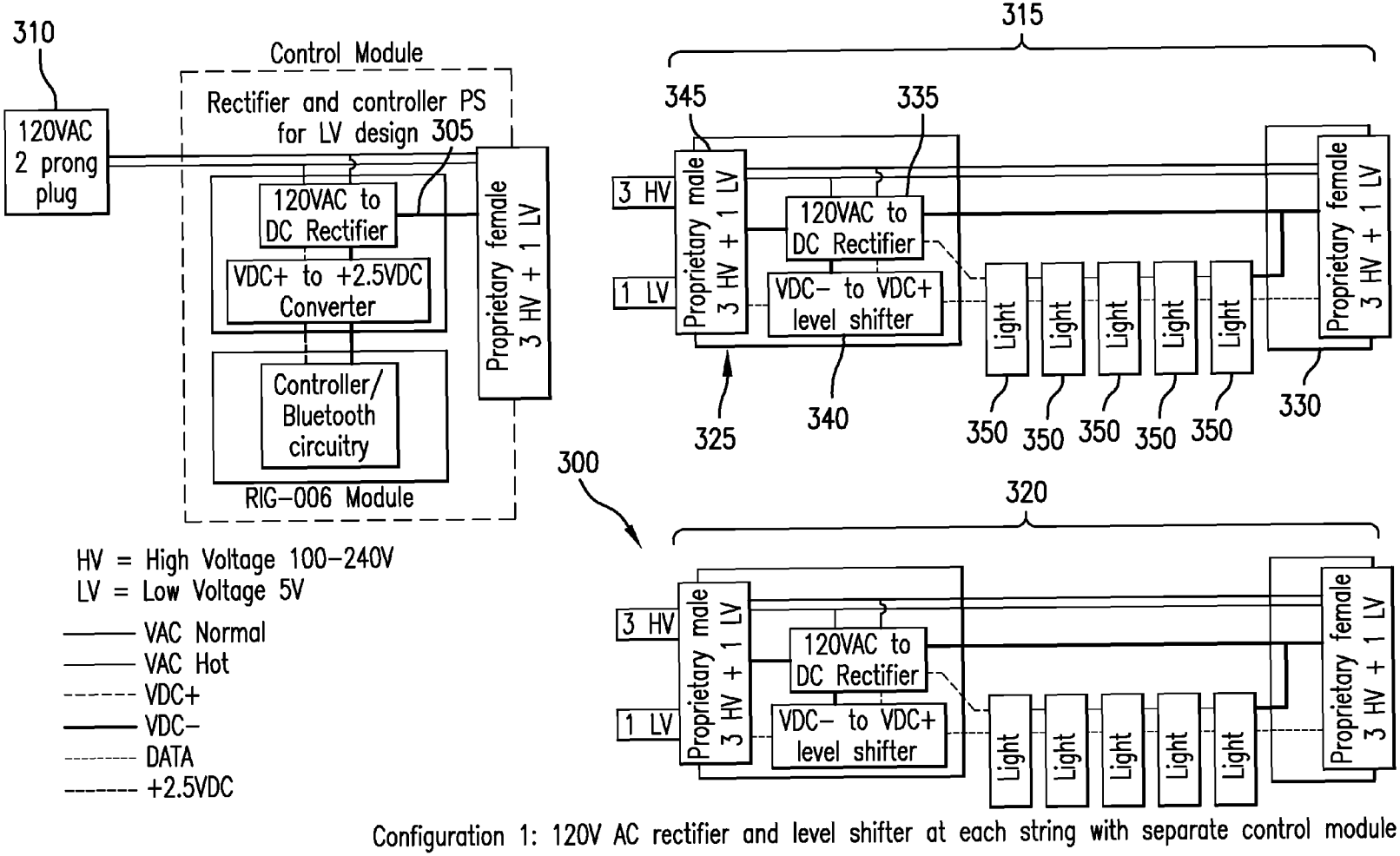
FIGS. 3A-3B depict schematics of exemplary lighting control systems.
Figure 3B:
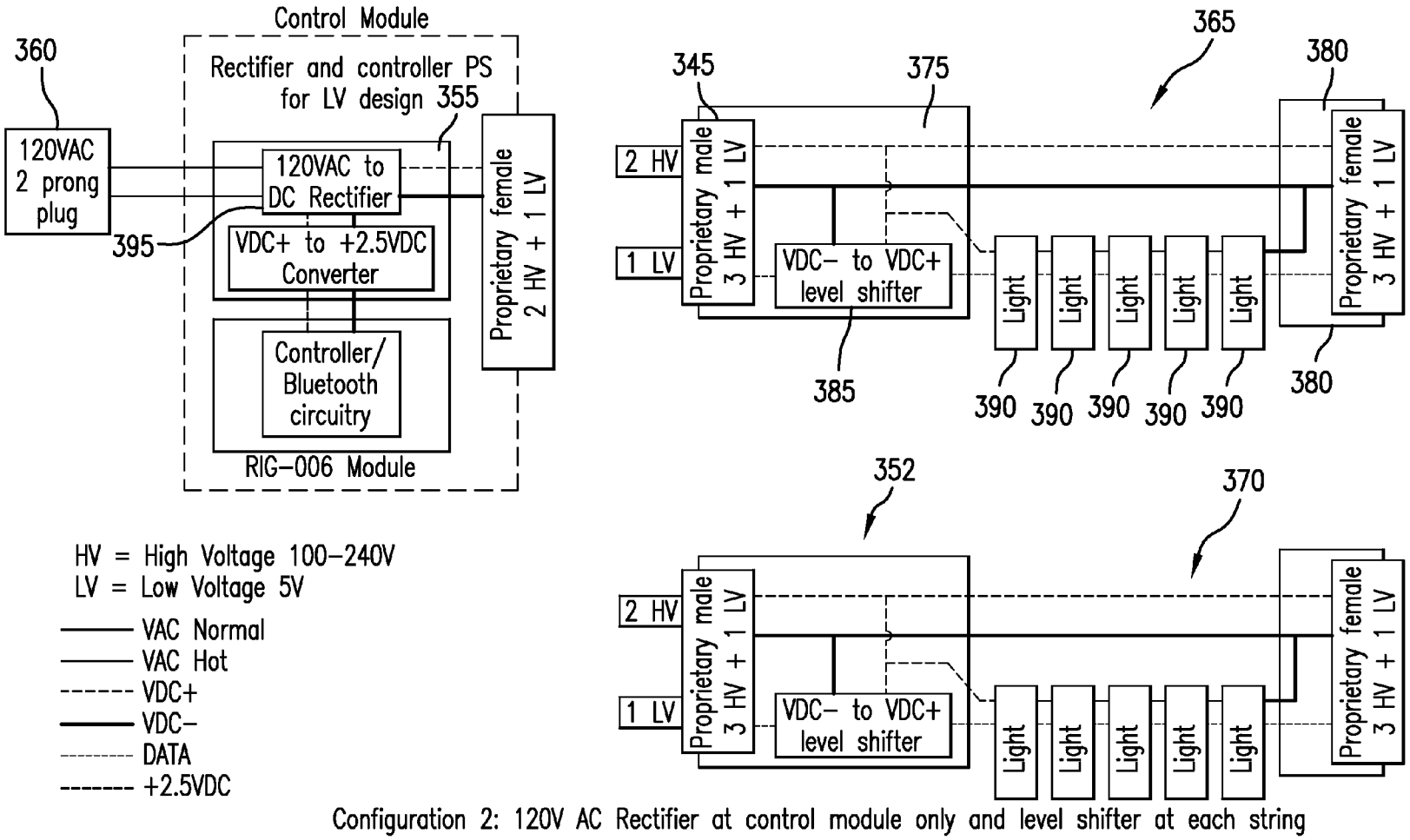

The FIG. 2C depicted controllable lighting element 294 has a sense module 295 connected to a lighting element bypass device 297. The control signal may include a sequence of control signal, each corresponding to a different one of the independently controllable lighting elements, for example. A sensing module 295, may actively cancel the control signal corresponding to the particular lighting element 293 to which the sensing module belongs. The lighting element bypass device 297 may absorb the portion of the control signal corresponding to the particular lighting element 293 to which the sense module belongs. The act of cancelling the portion of the control signal may result in the sensing of that same portion of the control signal. The sense module may communicate the sensed portion of the control signal to a control module 299. The FIGS. 3A-3B depict schematics of exemplary lighting control systems. In FIG. 3A, an exemplary lighting control system 300 includes a control module 305 powered by a 120 VAC line connector 310. A first LED light string 315 is coupled to the control module 305. A second LED light string 320 is coupled to the first LED light string 315. Additional LED light strings can be coupled in a serial fashion. The LED light strings 315, 320 each have an input module 325 and an output module 330. The input module 325 includes an AC/DC converter 335 and an active level shifter 340. The input module 325 also has an input connector 345 for receiving operating power and control signals from the control module 305. The active level shifter 340 adds a DC bias to the received control signal and couples the resulting biased control signal to a series connected string of independently controllable lighting elements 350.

The series connected independently controllable lighting elements 350 generate intermediate supply voltage levels between each pair of adjacent lighting elements. For example, if 80 volts DC is applied to an input supply pin of a first of the series of independently controllable lighting elements, some voltage drop will occur between the input supply pin and an output supply pin. If operation of the first lighting element results in a 5 volt drop between the input supply pin and the output supply pin, then 75 volts will be applied to the output supply pin.

The output supply pin of the first lighting element is electrically coupled to an input supply pin of a second lighting element. A voltage drop between the input and output supply pins of each subsequent lighting element may similarly result in a 5 volt drop across each lighting element, when operated. Thus a series of 16 lighting elements may result in the supply voltage at the output supply pin of the 16th element being at or near zero volts.

Each lighting element receives the control signal on an input control pin and supplies a control signal to an output supply pin. The control signal may also be level shifted to a voltage that is within an operating voltage range of the subsequent lighting element. For example, the second lighting element as described above may operate between 75 VDC and 70 VDC. The first lighting element may generate a current on the output control pin that corresponds to the control signal. The second lighting element may receive the current supplied by the first lighting element on the input control pin of the second lighting element. A resistor connected between the input control pin and the negative supply pin of the second lighting element may result in control signal having a voltage range between 70 volts and 75 volts. In such a fashion, the bias of the control signal may track the operating voltage range of the series connected lighting elements.

In FIG. 3B, an exemplary lighting control system 352 includes a control module 355 powered by a 120 VAC line connector 360. A first LED light string 365 is coupled to the control module 355. A second LED light string 370 is coupled to the first LED light string 365. Additional LED light strings can be coupled in a serial fashion. The control module may have an AC/DC converter for supplying DC operating power to the LED light strings 365, 270. The LED light strings 365, 370 each have an input module 375 and an output module 380. The input module 375 of each of the LED light strings 365, 370 has a level shifter 385 for biasing a received control signal to a level appropriate for use by a first of a series of independently controllable lighting elements 390. In the FIG. 3B embodiment, an AC/DC converter 395 is not needed for each LED light string 365, 370, because the control module has performed the AC/DC conversion and supplied the resulting DC operating power to an output supply pin 385 of the control module 355.

Figure 4:
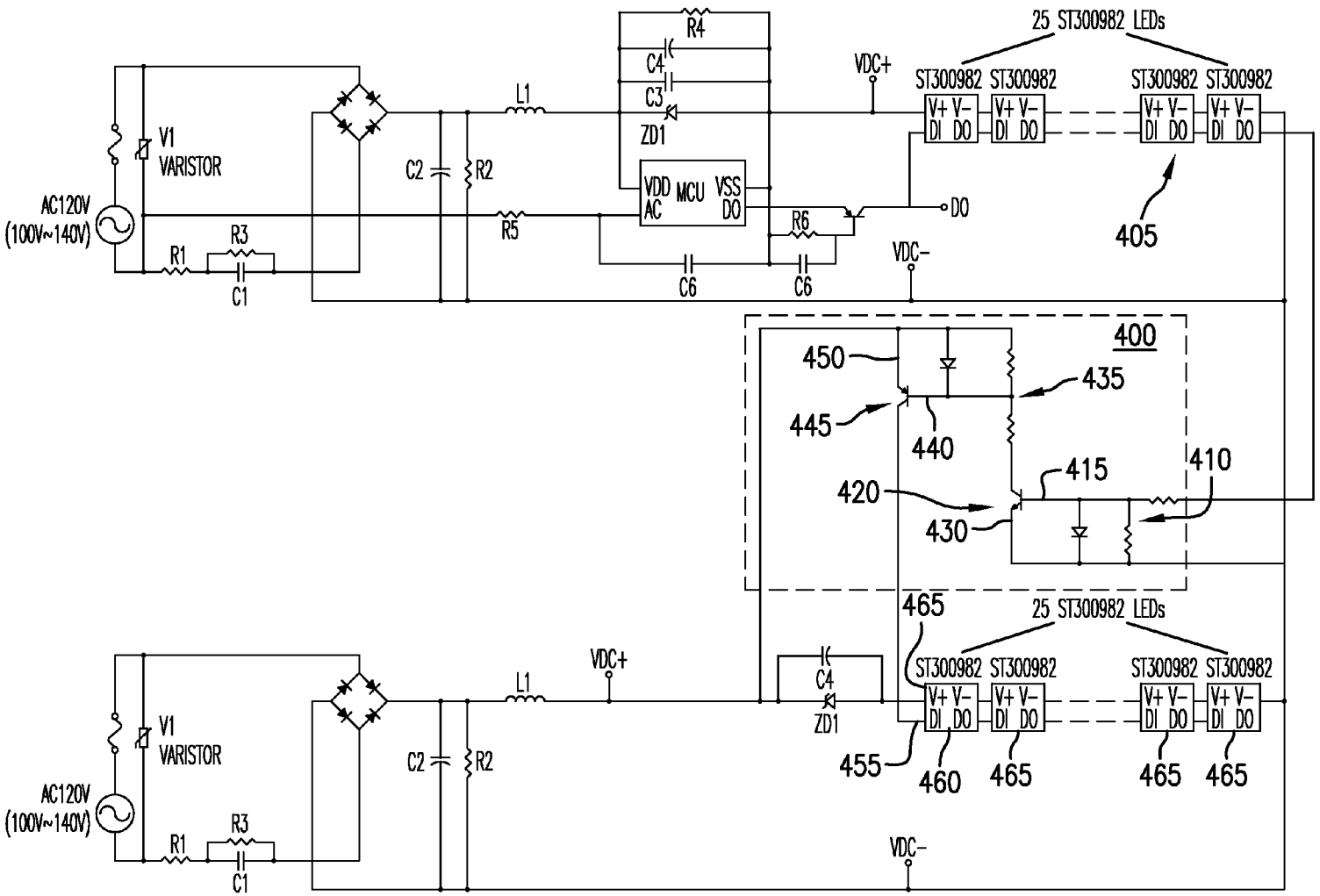
FIG. 4 depict a schematic of an exemplary light string having independently controllable lighting elements.

FIG. 4 depicts a schematic of an exemplary light string having independently controllable lighting elements. In the FIG. 4 depiction, an active level shifter 400 receives a control signal from a first LED light string 405. The active level shifter 400 applies the received control signal across a resistor divider 410. The resulting voltage of the resistor divider 410 is then coupled to a base 415 of an NPN transistor 420, an emitter 430 of which is connected to circuit ground reference potential. The resistor divided control signal modulates the collector current of the NPN transistor 420 which is applied across a second resistor divider 435 biased from a DC supply voltage. The output of the second resistor divider 435 is coupled to a base 440 of a PNP transistor 445, whose emitter 450 is connected to the DC supply voltage. The resistor divided control signal modulates the collector current of the PNP transistor 445 which is coupled to an input control pin 455 of a first 460 in a series of independently controllable lighting elements 465.

Figure 5:
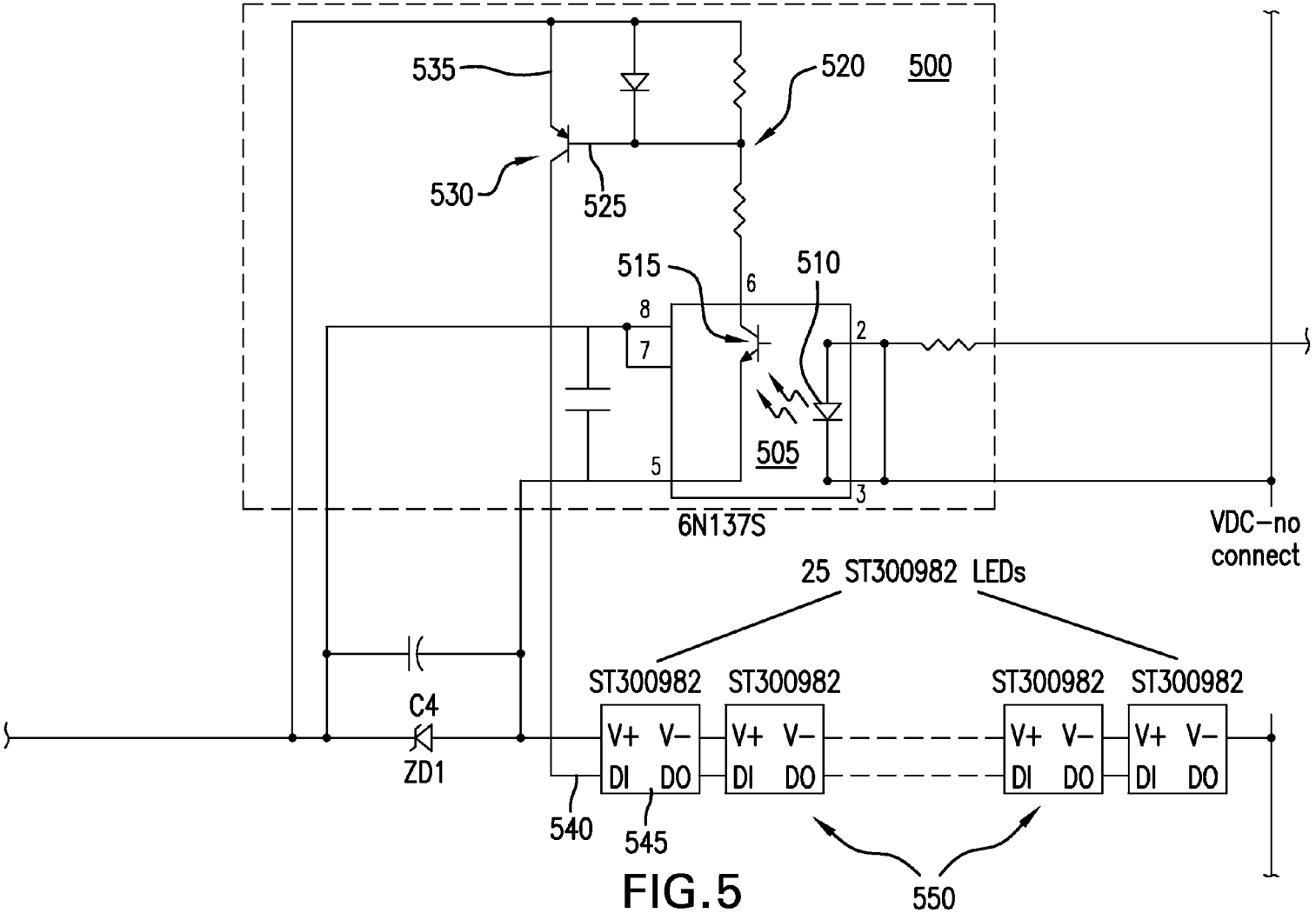
FIG. 5 depicts a schematic of an exemplary control signal level shifter of an LED light string.

FIG. 5 depicts a schematic of an exemplary control signal level shifter of an LED light string. In the FIG. 5 depiction, an active level shifter 500 receives a control signal from a first LED light string (not depicted). The active level shifter 500 applies the received control signal to an input pin of an optocoupler 505. The control signal modulates the light output of a light emitting diode 510 within the optocoupler 505. The light illuminates a base region of an NPN transistor 515 creating electron-hole pairs therein. These electron-hole pairs cause the collector current of the NPN transistor 515 to be modulated in response to the control signal. The modulated collector current is presented to a resistor divider 520. The output of the resistor divider 520 is coupled to a base 525 of a PNP transistor 530, whose emitter 535 is connected to the DC supply voltage. The resistor divided control signal modulates the collector current of the PNP transistor 530 which is coupled to an input control pin 540 of a first 545 in a series of independently controllable lighting elements 550.

Figure 6:
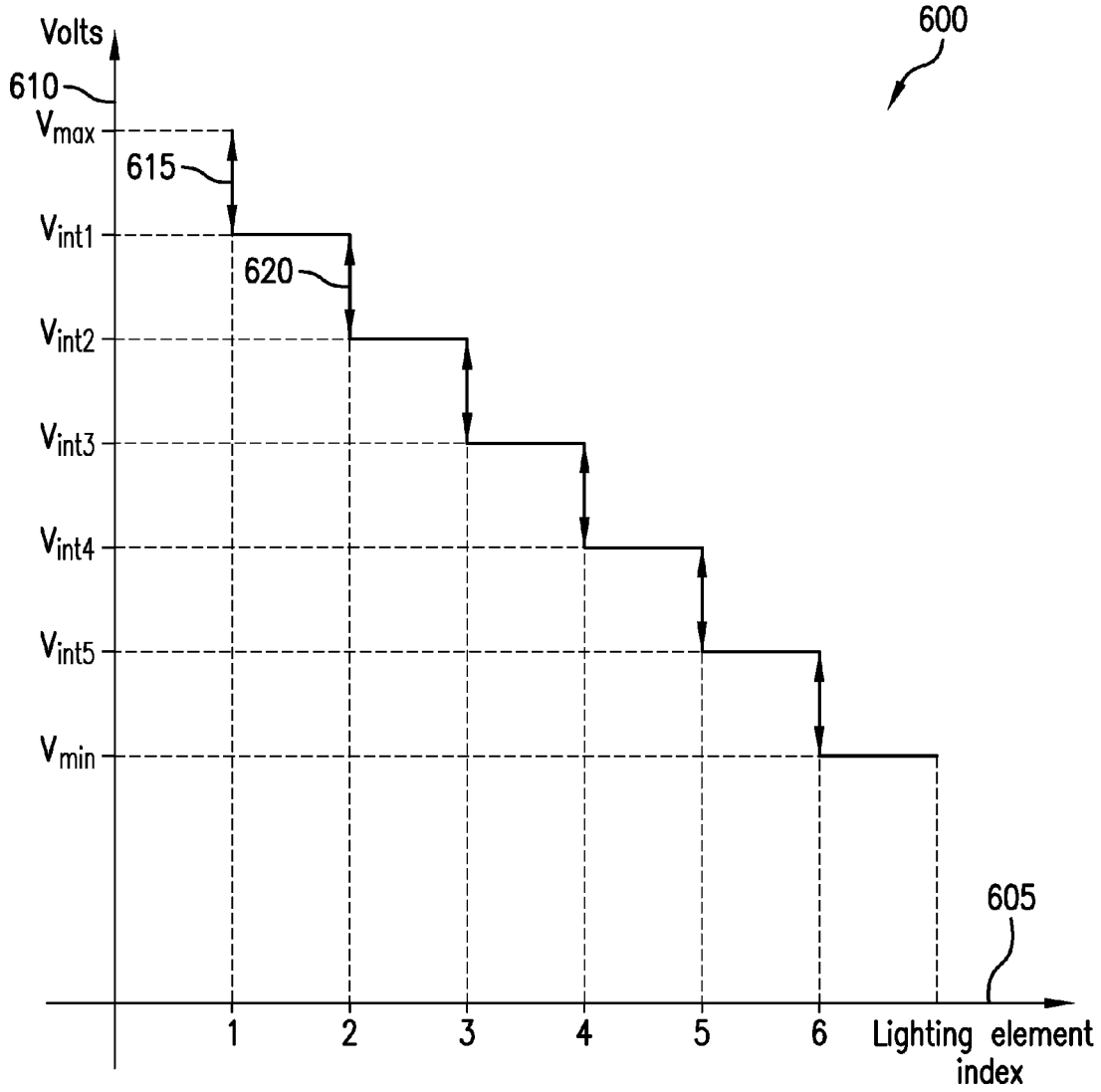
FIG. 6 depicts an exemplary graph of intermediate supply voltages at the power connection between adjacent pairs of lighting elements.

FIG. 6 depicts an exemplary graph of intermediate supply voltages at the power connection between adjacent pairs of lighting elements. In FIG. 6, a graph 600 has a horizontal axis 605 that represents an index of a lighting element. In the exemplary graph, six lighting elements are enumerated on the horizontal axis representing an LED light string of six LEDs. The graph 600 has a vertical axis 610 that represents the voltage measured at the supply terminals of the various lighting elements. A first lighting element has a voltage identified as Vmax applied to a positive supply pin. A voltage drop from the positive supply pin to the negative supply pin may result when the first lighting element is operated and draws current from the positive supply pin. The voltage at the negative supply pin is labeled as Vint1 (intermediate voltage 1). The term intermediate is used to describe this supply level as it is the voltage at both the negative supply pin for the first lighting element and the voltage at the positive supply pin of a second lighting element.

The operating voltage range 615 of the first lighting element is therefore defined as the voltages between the positive and negative supply pins, or between Vmax and Vint1. The control signal supplied to a control pin of the first lighting element may therefore be biased within the operating supply voltage range of the first lighting element. The second lighting element, similarly, has an operating supply voltage 620 range between Vint1 and Vint2. Such cascading supply voltage ranges corresponding to successive lighting elements may require level shifting of control signals from element to element. If another series of lighting elements were to be connected to and be dependent upon the control signal provided by the last lighting element of the series, level shifting of the control signal may be required.

Although various embodiments have been described with reference to the Figures, other embodiments are possible. For example, in some embodiments, Single long LED light string may require a series of lighting elements to be split into two or more substrings. For example, a series of 32 lighting elements may require the series to be split into two substrings of 16 lighting elements apiece. Each of the substrings may provide a positive supply voltage of Vmax to a positive supply pin to a first lighting element of each substring. Between the two substrings, an active level shifter may provide a proper DC bias to a control signal provided by a last element of the first substring for use at an input control pin of a first element of the second substring.

In some embodiments, wireless transmission of lighting control may be performed using a mobile device. For example, a cell phone may run a lighting control app. In some embodiments, a tablet computer may run a lighting control program. Transmission between a mobile device a lighting system may be wireless. Various transmission protocols may be used when transmitting lighting commands. For example, transmission may be performed using Bluetooth and/or ZigBee and/or Wi-Fi, or other protocols. In some embodiments, IR light transmission of lighting controls may be used, for example. In some embodiments, transmission may be directly between lighting elements and a mobile device. In some embodiments, transmission may be from a mobile device to a control module, for example. In some embodiments, a lighting display may be controlled from a wireless router. In some embodiments, a control module may use wireless cellphone protocols for transmission. Control signals may be sent to such a control module via a phone call (and/or a text message), for example.

In various embodiments, various methods of controlling lighting elements may be used. Some such methods have been described, for example, at [0043-0048] and in FIG. 8 of U.S. patent application Ser. No. 13/426,577, titled "Low Voltage Coupling Design," filed by hangmen Yi Xin Long on Mar. 21, 2012, the entire disclosure of which is hereby incorporated by reference.

In various embodiments, various tree ornaments may be coupled to a holiday tree. For example, illuminated ornaments may be coupled to a power and control network of a tree. In some embodiments, a tree ornament may be coupled to a coupling site on a tree limb or on a tree trunk segment. In some embodiments, an ornament may couple to a light string. For example, in some embodiments, a lighted tree ornament may have a connector configured as a light element of a light string. For example, the connector may replace a light element and draw power from the light element's connector on the light string. In some embodiments, the tree ornament may be battery powered. In some embodiments, the tree ornament may draw power from the tree's power distribution network. In some embodiments, the tree ornament may receive control signals via the tree's control signal distribution network. In an exemplary embodiment, a tree ornament may receive control signals wireless (e.g. Bluetooth, ZigBee, Wi-Fi, etc.).

In various embodiment, various methods of providing power and control to illuminated holographic tree ornament may be used. Some such holographic tree ornaments have been described, for example, at [0007-0008 and 0013] and in FIG. 1 of U.S. patent application Ser. No. 13/767,833, titled "Decorative Holographic Ornament," filed by Jason Loomis on Feb. 14, 2013, the entire disclosure of which is hereby incorporated by reference.

The illuminated tree top ornament apparatus of the present invention provides a tree top ornament with one or an array of LED or other lights, with an attachment mechanism for releasable attachment to the top branch or trunk of artificial and natural trees. The lights are connected to a sleeve designed to fit over the top vertical branch of the tree, but which is supported by a rigid conduit that clamps to the tree branch some distance below the top, so that the top of the branch does not itself bear any of the tree top ornament's weight. The user may selectively attach a variety of clear and semi clear acrylic or glass ornamental tree toppers for illumination by the lights.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the first receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using Omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Fire wire, ATA/IDE, RS-232, RS-422, RS-485, 802.11a/b/g, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

In an exemplary embodiment, a light string having series-connected independently controllable lighting elements may have a DC supply voltage provided to a positive supply pin of a first lighting element of the light string. Each pair of adjacent lighting elements may be connected via a negative supply pin of a first lighting element of the adjacent pair and a positive supply pin of a second lighting element of the adjacent pair. A current source may be applied to a negative supply pin of a last lighting element of the light string. The current source may be controlled by a control module of the light string. The control module may determine the current of the current source in response to a control signal received by an input connector of the light string. The control signal may have independent control subsignals for each of a plurality of independently controllable lighting elements. Each control subsignal may correspond to a current level of a lighting element. The control module may control the current source to be substantially equal to the maximum current level corresponding to the control subsignals associated with the lighting elements of the light string. In some embodiments, the control module may modify the control signal before sending the control signal to the active level shifter.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. A modular light-string system comprising:

a pluggable input connector configured to receive operating power and an input light-string control signal;

a series-connected plurality of independently controllable lighting elements generating a series of distinct intermediate supply-voltage levels each shared by a negative supply pin of a first lighting element of an adjacent pair of lighting elements and a positive supply pin of a second element of the adjacent pair of lighting elements, the second lighting element of each adjacent pair receiving the control signal from the first lighting element of the adjacent pair;

wherein each of said lighting elements has a control module and a plurality of independently controllable Light Emitting Diodes (LEDs), the control module generating an illumination signal for each of the plurality of LEDs in response to the received control signal, wherein the received control signal comprises a plurality of independent control subsignals that correspond to each of the plurality of independently controllable lighting elements, respectively;

a level shifter comprising an optocoupler and configured to actively translate the control signal received by the input connector from a first voltage range to a second voltage range, wherein the second voltage range is between a DC voltage supplied to the positive supply pin of the first lighting element of the series-connected plurality of independently controllable lighting elements and the intermediate supply voltage between the first and second lighting elements of the series-connected plurality of independently controllable lighting elements, and wherein the output of the optocoupler is biased between an electrical connection to the received operating power and an electrical connection to the positive supply pin of the first lighting element; and, a pluggable output connector configured to provide the received operating power and the control signal output by a last lighting element in the series-connected plurality of independently controllable lighting elements to another modular light-string system, when connected, wherein each of the series-connected plurality of independently controllable lighting element has a single level shifter.

2. The modular light-string system of claim 1, wherein the optocoupler comprises an input terminal and an output terminal.

3. The modular light-string system of claim 2, wherein the output terminal of the optocoupler is electrically coupled to a first terminal of a resistor.

4. The modular light-string system of claim 3, further comprising a transistor having an input terminal and an output terminal, the input terminal electrically coupled to a second terminal of the resistor, the output terminal configured to generate a translated control signal corresponding the input control signal received by the input connector.

5. The modular light-string system of claim 1, further comprising a first supply voltage, wherein the first supply voltage comprises an AC voltage.

6. The modular light-string system of claim 5, further comprising an AC/DC converter that converts the first supply voltage to the DC voltage supplied to the positive supply pin of the first lighting element of the series-connected plurality of independently controllable lighting elements.

7. The modular light-string system of claim 6, wherein the DC voltage is greater than fifty volts.

8. The modular light-string system of claim 1, further comprising a first supply voltage, wherein the first supply voltage comprises a DC voltage.

9. The modular light-string system of claim 1, further comprising a second supply voltage, wherein the second supply voltage is substantially a circuit ground reference potential.

* * * * *